US010607570B2

(12) United States Patent
Mese et al.

(10) Patent No.: US 10,607,570 B2
(45) Date of Patent: Mar. 31, 2020

(54) BRIGHTNESS CONTROL METHOD, APPARATUS AND PROGRAM PRODUCT

(71) Applicant: LENOVO (SINGAPORE) PTE. LTD., Singapore (SG)

(72) Inventors: John Carl Mese, Cary, NC (US); Nathan J. Peterson, Oxford, NC (US); Russell Speight VanBlon, Raleigh, NC (US); Rod D. Waltermann, Rougemont, NC (US)

(73) Assignee: Lenovo (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 15/846,708

(22) Filed: Dec. 19, 2017

(65) Prior Publication Data

US 2018/0122337 A1 May 3, 2018

Related U.S. Application Data

(63) Continuation of application No. 14/746,420, filed on Jun. 22, 2015, now Pat. No. 9,892,714, which is a continuation-in-part of application No. 13/535,992, filed on Jun. 28, 2012, now abandoned.

(51) Int. Cl.
*G09G 5/10* (2006.01)
*G09G 3/20* (2006.01)

(52) U.S. Cl.
CPC ..... *G09G 5/10* (2013.01); *G09G 3/20* (2013.01); *G09G 2320/0606* (2013.01); *G09G 2320/0626* (2013.01); *G09G 2354/00* (2013.01); *G09G 2360/144* (2013.01)

(58) Field of Classification Search
CPC ..... G09G 2320/0606; G09G 5/30; G09G 2360/144; G09G 3/20; G09G 5/10
See application file for complete search history.

(56) References Cited

U.S. PATENT DOCUMENTS 7,605,829 B2 10/2009 Oh
8,269,802 B2 * 9/2012 Fujine ..... G09G 5/00 345/102
8,487,786 B1 * 7/2013 Hussey ..... G08G 5/0021 340/955

(Continued)

FOREIGN PATENT DOCUMENTS

EP 1503363 A2 2/2005
WO 2008026066 A1 3/2008
WO 2010070721 A1 6/2010

*Primary Examiner* — Samantha (Yuehan) Wang
(74) *Attorney, Agent, or Firm* — John M. Rogitz; John L. Rogitz

(57) ABSTRACT

A method, apparatus and program product which enable a user selected display brightness to be linked to an application program selected for use in an electronic device such as a computer system, tablet, telephone, electronic book reader, game device, music playing device and the like. A user selected adjustment of display brightness for an application program and a then existing ambient lighting condition are stored in storage during use of the application program. In response to subsequent opening of an application program for which data has been stored, the stored data is accessed and display brightness relative to the ambient lighting condition present at the subsequent opening is given the previous, stored, user selected adjustment.

20 Claims, 5 Drawing Sheets

(56) References Cited

U.S. PATENT DOCUMENTS 8,872,753 B2 10/2014 Glen
9,817,673 B2 * 11/2017 Poornachandran ... G06F 9/4401
9,892,714 B2 2/2018 Mese et al.
2002/0118182 A1 * 8/2002 Luther Weindorf ..... G09G 3/20 345/204
2004/0183765 A1 9/2004 Morisawa
2004/0207613 A1 10/2004 Morisawa
2005/0017994 A1 1/2005 Oh
2006/0256067 A1 * 11/2006 Montero ..... G09G 3/3406 345/102
2007/0273714 A1 * 11/2007 Hodge ..... G09G 3/20 345/690
2008/0055228 A1 3/2008 Glen
2008/0165115 A1 7/2008 Herz et al.
2008/0192140 A1 8/2008 Lee et al.
2009/0170479 A1 * 7/2009 Jarenskog ..... H04M 1/72572 455/414.1
2010/0328081 A1 * 12/2010 Hu ..... H01M 8/04007 340/586
2011/0095875 A1 * 4/2011 Thyssen ..... G09G 5/10 340/407.1
2011/0131153 A1 * 6/2011 Grim, III ..... G06Q 30/0283 705/400
2012/0001960 A1 1/2012 Herz et al.
2012/0218320 A1 8/2012 Evanicky et al.
2013/0100096 A1 * 4/2013 Webster ..... G09G 3/3466 345/207
2013/0221855 A1 8/2013 Lazaridis et al.
2013/0235073 A1 * 9/2013 Jaramillo ..... G09G 5/00 345/619
2013/0328842 A1 * 12/2013 Barnhoefer ..... G09G 3/3406 345/207
2014/0002473 A1 1/2014 Mese et al.
2015/0287389 A1 10/2015 Mese et al.
2016/0116974 A1 * 4/2016 Ginnela ..... G06F 1/3287 713/2
2016/0180809 A1 * 6/2016 Mickelsen ..... H04N 21/42221 345/207

* cited by examiner

BRIGHTNESS CONTROL METHOD, APPARATUS AND PROGRAM PRODUCT

FIELD AND BACKGROUND

A user's experience with electronic devices such as computer systems, tablets, telephones, electronic book readers, game devices, music playing devices and the like is impacted by the brightness of the display provided. Many such devices provide ambient light condition sensors and circuitry and executing program code which adjust brightness in response to variations in such ambient lighting. Many such devices accept or provide program code enabling a range of activities such as word processing, internet access and searching, data capture for purposes of downloading program code and data such as web sites or electronic publications.

A user in exercising such program code, here as in common usage called application programs, may find that display brightness provided by the device is not the best for their individual viewing. For that reason, it is commonplace for the program code provided with or in the device to enable user adjustment of display brightness. Usually such functionality is provided at the operating system code level. Using this functionality, a user may adjust the display brightness while using an application program to adapt the device to the user's preferences. However, such adjustments are made for each application program and each time that the application program is initiated.

SUMMARY

What is disclosed and taught in the description which follows are a method, apparatus and program product which enable a user selected display brightness to be linked to an application program selected for use in a device of the types mentioned above. In particular, a user selected adjustment of display brightness for an application program and a then existing ambient lighting condition are stored in storage during use of the application program. In response to subsequent opening of an application program for which data has been stored, the stored data is accessed and display brightness relative to the ambient lighting condition present at the subsequent opening is returned to the previous, stored, user selected adjustment.

The details of present principles, both as to their structure and operation, can best be understood in reference to the accompanying drawings, in which like reference numerals refer to like parts, and in which:

BRIEF DESCRIPTION OF DRAWINGS

Some purposes having been stated, others will appear as the description proceeds, when taken in connection with the accompanying drawings, in which.

DETAILED DESCRIPTION

Figure 1:
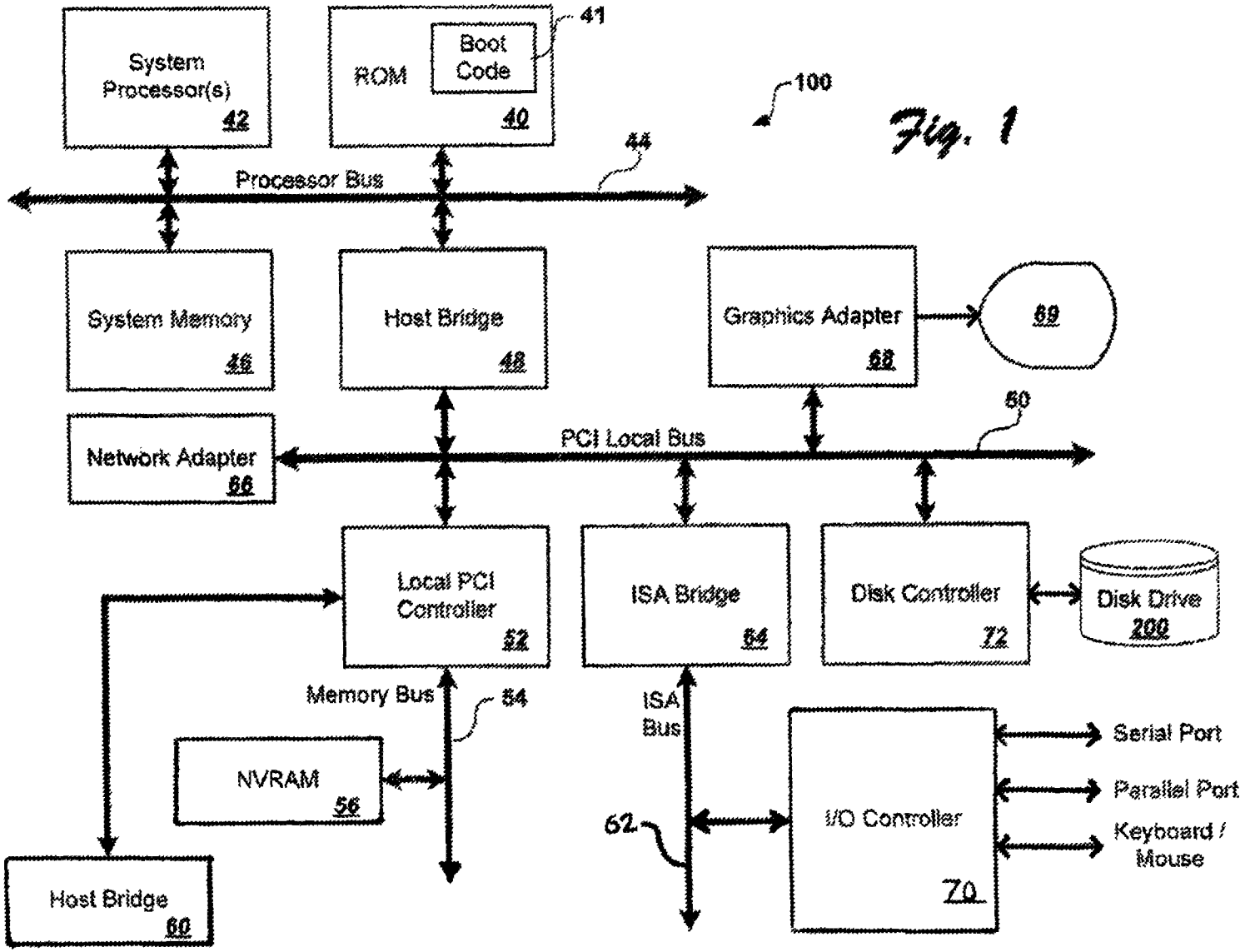
FIG. 1 is an example of a computer system in which the technology described here may be implemented.

This disclosure relates generally to device-based information. With respect to any computer systems discussed herein, a system may include server and client components, connected over a network such that data may be exchanged between the client and server components. The client components may include one or more computing devices including televisions (e.g., smart TVs, Internet-enabled TVs), computers such as desktops, laptops and tablet computers, so-called convertible devices (e.g., having a tablet configuration and laptop configuration), and other mobile devices including smart phones. These client devices may employ, as non-limiting examples, operating systems from Apple, Google, or Microsoft. A Unix or similar such as Linux operating system may be used. These operating systems can execute one or more browsers such as a browser made by Microsoft or Google or Mozilla or other browser program that can access web applications hosted by the Internet servers over a network such as the Internet, a local intranet, or a virtual private network.

As used here instructions refer to computer-implemented steps for processing information in the system. Instructions can be implemented in software, firmware or hardware; hence, illustrative components, blocks, modules, circuits, and steps are set forth in terms of their functionality.

A processor may be any conventional general purpose single- or multi-chip processor that can execute logic by means of various lines such as address lines, data lines, and control lines and registers and shift registers. Moreover, any logical blocks, modules, and circuits described herein can be implemented or performed, in addition to a general purpose processor, in or by a digital signal processor (DSP), a field programmable gate array (FPGA) or other programmable logic device such as an application specific integrated circuit (ASIC), discrete gate or transistor logic, discrete hardware components, or any combination thereof designed to perform the functions described herein. A processor can be implemented by a controller or state machine or a combination of computing devices.

Any software and/or applications described by way of flow charts and/or user interfaces herein can include various sub-routines, procedures, etc. It is to be understood that logic divulged as being executed by, e.g., a module can be redistributed to other software modules and/or combined together in a single module and/or made available in a shareable library.

Logic when implemented in software, can be written in an appropriate language such as but not limited to C# or C++, and can be stored on or transmitted through a computer-readable storage medium (e.g., that may not be a transitory signal) such as a random access memory (RAM), read-only memory (ROM), electrically erasable programmable read-only memory (EEPROM), compact disk read-only memory (CD-ROM) or other optical disk storage such as digital versatile disc (DVD), magnetic disk storage or other magnetic storage devices including removable thumb drives, etc. A connection may establish a computer-readable medium. Such connections can include, as examples, hard-wired cables including fiber optics and coaxial wires and twisted pair wires. Such connections may include wireless communication connections including infrared and radio.

In an example, a processor can access information over its input lines from data storage, such as the computer readable storage medium, and/or the processor can access information wirelessly from an Internet server by activating a wireless transceiver to send and receive data. Data typically is converted from analog signals to digital by circuitry between the antenna and the registers of the processor when being received and from digital to analog when being transmitted. The processor then processes the data through its shift registers to output calculated data on output lines, for presentation of the calculated data on the device.

Components included in one embodiment can be used in other embodiments in any appropriate combination. For example, any of the various components described herein and/or depicted in the Figures may be combined, interchanged or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and or A, B, and C together, etc.

"A system having one or more of A, B, and C" (likewise "a system having one or more of A, B, or C" and "a system having one or more of A, B, C") includes systems that have A alone, B alone, C alone, A and B together, A and C together, B and C together, and/or A, B, and C together, etc.

The term "circuit" or "circuitry" is used in the summary, description, and/or claims. As is well known in the art, the term "circuitry" includes all levels of available integration, e.g., from discrete logic circuits to the highest level of circuit integration such as VLSI, and includes programmable logic components programmed to perform the functions of an embodiment as well as general-purpose or special-purpose processors programmed with instructions to perform those functions.

While the present technology will be described more fully hereinafter with reference to the accompanying drawings, in which preferred embodiments are shown, it is to be understood at the outset of the description which follows that persons of skill in the appropriate arts may modify what is here described while still achieving the favorable results contemplated. Accordingly, the description which follows is to be understood as being a broad, teaching disclosure directed to persons of skill in the appropriate arts, and not as limiting upon the scope of the claims.

Referring now to FIG. 1, what is there shown and will be here described is an example of an electronic apparatus, in particular a computer system, useful in practicing this technology. It will be understood by knowledgeable readers that computer systems vary in complexity, size and capability. The showing and description here should thus be understood as an example only. It is contemplated that the techniques will be implemented through the available range of computing apparatus and related devices as mentioned above.

FIG. 1 is a block diagram of a computer system 100 according to an embodiment of the present technology which incorporates at least one system processor 42, which is coupled to a Read-Only Memory (ROM) 40 and a system memory 46 by a processor bus 44. System processor 42 is a general-purpose processor that executes boot code 41 stored within ROM 40 at power-on and thereafter processes data under the control of operating system and application programs stored in system memory 46. System processor 42 is coupled via processor bus 44 and host bridge 48 to Peripheral Component Interconnect (PCI) local bus 50.

PCI local bus 50 supports the attachment of a number of devices, including adapters and bridges. Among these devices is network adapter 66, which interfaces computer system 100 to LAN 10, and graphics adapter 68, which interfaces computer system 100 to display 69. Communication on PCI local bus 50 is governed by local PCI controller 52, which is in turn coupled to non-volatile random access memory (NVRAM) 56 via memory bus 54. Local PCI controller 52 can be coupled to additional buses and devices via a second host bridge 60.

Computer system 100 further includes Industry Standard Architecture (ISA) bus 62, which is coupled to PCI local bus 50 by ISA bridge 64. Coupled to ISA bus 62 is an input/output (I/O) controller 70, which controls communication between computer system 12 and attached devices such as a keyboard, mouse, a disk controller 72, and a disk drive. In addition, I/O controller 70 supports external communication by computer system 100 via serial and parallel ports.

Figure 2:
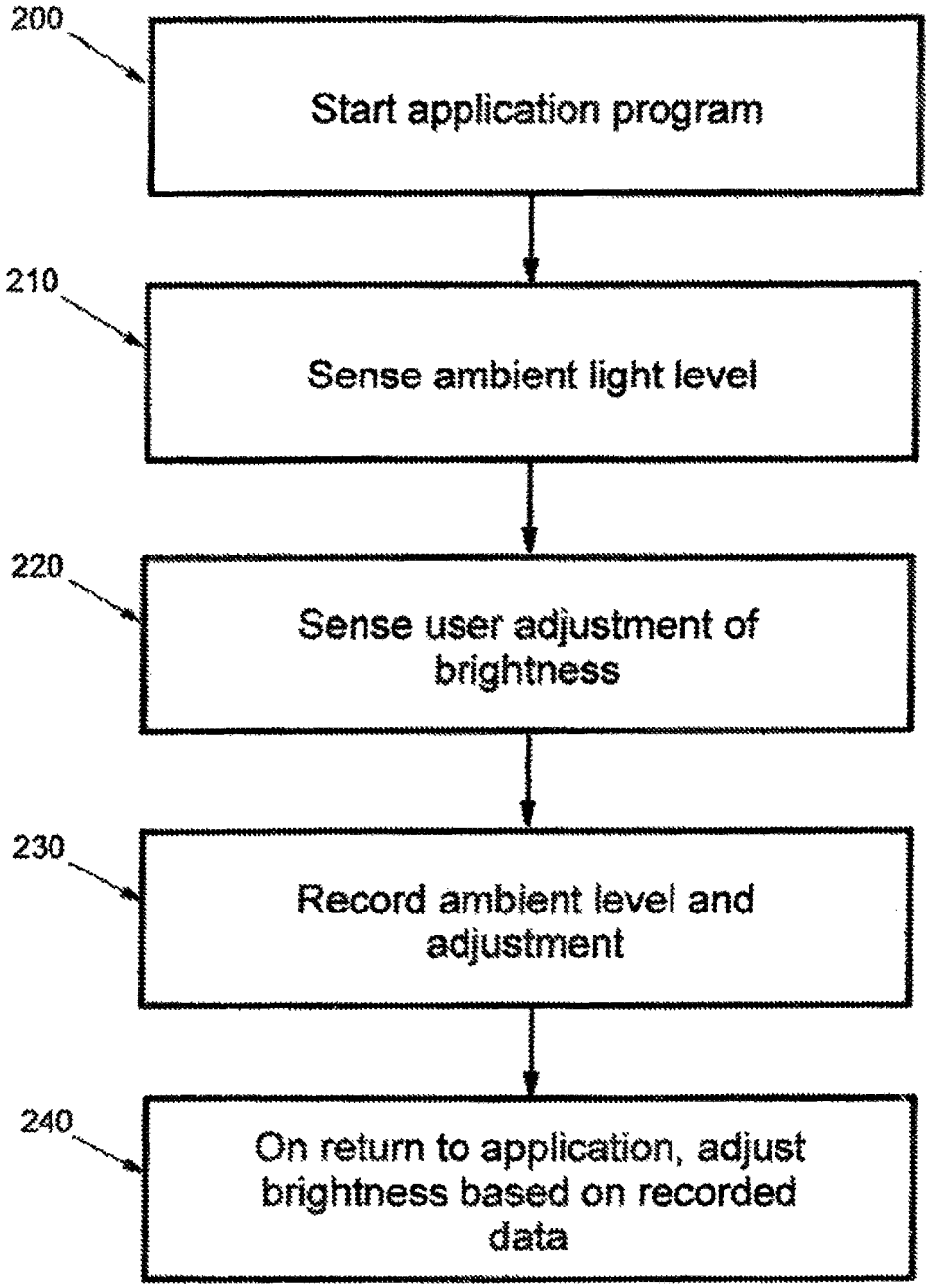
FIG. 2 is a flow chart showing an implementation of the technology here described.

Referring now to FIG. 2, a sequence which follows the execution of the method of this technology in an apparatus of the types described is there shown. On a user starting an application program (200), the device used will sense ambient light conditions (210). In the event that the user makes any adjustment of the brightness level of the display, toward increased or decreased brightness, that adjustment is sensed (220). The ambient light conditions existing at startup of the application program and the user adjust of brightness are recorded in the device memory in a form accessible to the device processor, such as a data base of application programs, sensed ambient conditions, and sensed user adjustments (230). On a return to use of the application program at some later time, display brightness will be adjusted to the recorded user preference taking into account the ambient lighting conditions at the time of return to the program.

User adjustment may be done in a number of varying ways, depending on choices made available through the operating system design. In one embodiment, the user adjustment may be by steps, such as an increase or decrease by 10%, 20%, 30% etc. In an alternate embodiment, the user adjustment may be along a continuum, with simple selection of a point along a range of from dim to very bright. In yet another embodiment, the user adjustment may be as a percentage of ambient light sensed. Further, in any of these embodiments the user adjustments, which may vary from time to time regardless of ambient lighting conditions due to variations in user preference, can be gathered over the passage of time, resulting in generation of a light curve unique to each application program and applied automatically. As the user continues to make adjustments, the light curve becomes more accurate increasing viewer comfort and potentially lowering the discharge rate of any battery supporting operation of the device. It is contemplated that, in response to opening of an application program for which data defining any user selected adjustment of display brightness is absent, the device will select a brightness level appropriate to the then present ambient lighting condition. Should the user then make an adjustment in display brightness, then the process described here would begin.

Figure 3:
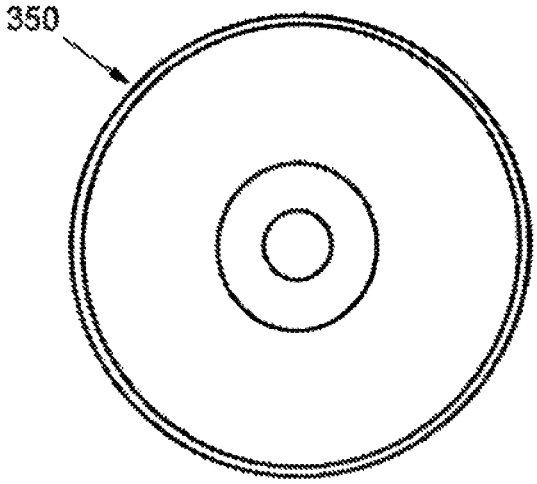
FIG. 3 is a representation of a tangible computer readable medium bearing, executable program code which will implement the techniques here described.

Referring now to FIG. 3, one or more aspects of the present technology can be included in an article of manufacture (e.g., one or more computer program products) having, for instance, tangible computer usable media, indicated at 350 in FIG. 3. The media has embodied therein, for instance, computer readable program code for providing and facilitating the capabilities of the methods and apparatus described. The article of manufacture can be included as a part of a computer system or sold separately. Machine readable storage mediums may include fixed hard drives, optical discs such as the disc 350, magnetic tapes, semiconductor memories such as read only memories (ROMs), programmable memories (proms of various types), flash memory, etc. The article containing this computer readable code is utilized by executing the code directly from the storage device, or by copying the code from one storage device to another storage device, or by transmitting the code on a network for remote execution.

Figure 4:
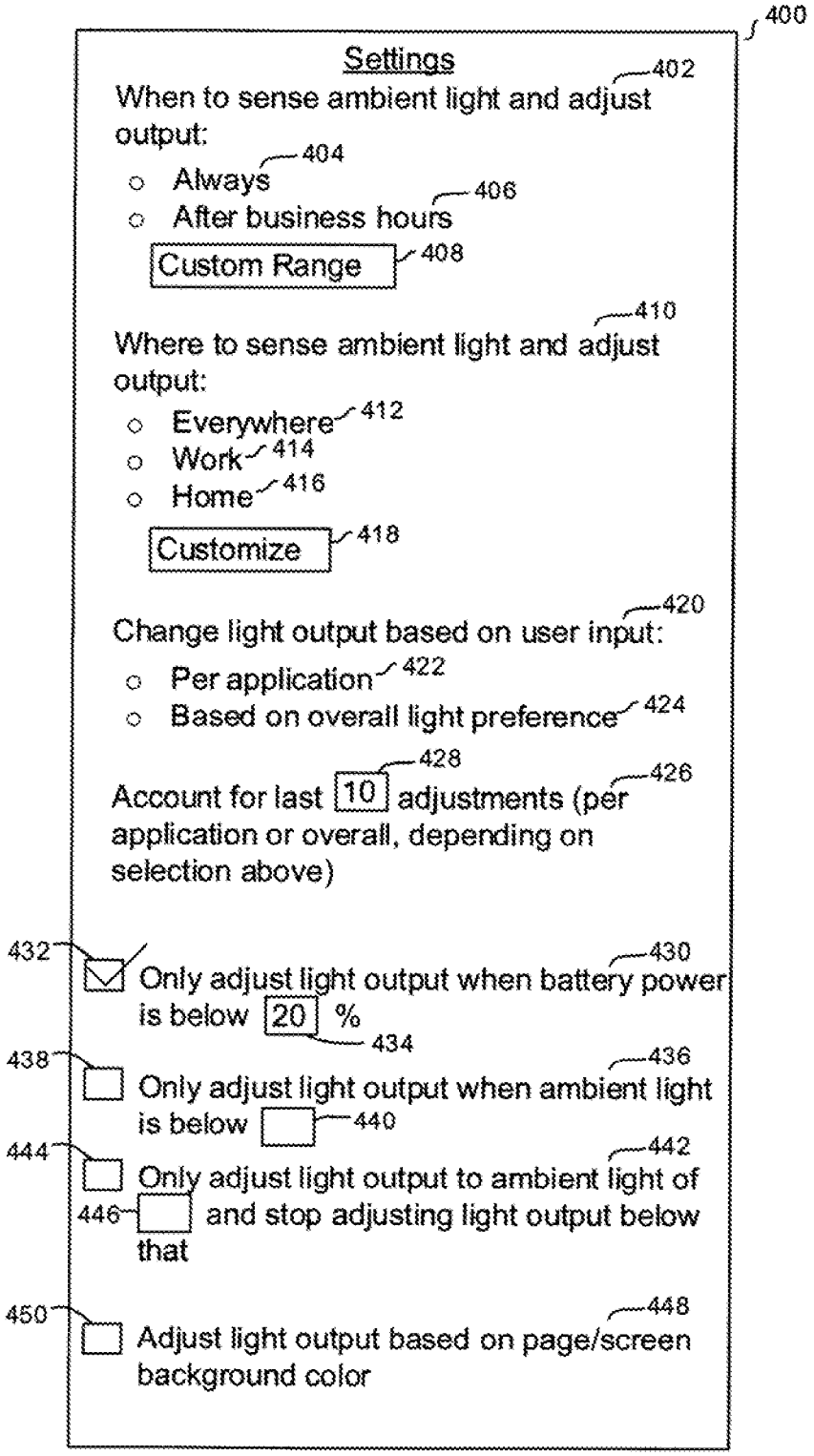
FIGS. 4-5 are example user interfaces presentable on a display in accordance with present principles.

Continuing the detailed description in reference to FIG. 4, it shows an example user interface (UI) 400 presentable on a display of a device undertaking present principles. The UI 400 includes a first setting 402 for providing input indicating times at which the device is to sense ambient light and/or adjust display brightness output in accordance with present principles. Thus, a first option 404 is selectable by a user (e.g., based on touch input and/or cursor-based input) to always sense ambient light and adjust display brightness when, e.g., a user initiates an application. A second option 406 is also shown which is selectable by a user to, e.g., upon launch of an application, sense ambient light and/or adjust display brightness output when the user input to launch is received after business hours (e.g., times other than Monday through Friday, 9 a.m. to 5 p.m. on regular business days). Furthermore, note that the setting 402 includes a custom range selector 408 which is selectable to cause another option and/or UI to be presented at which a user may enter a custom range(s) for when the device is to sense ambient light and/or adjust display brightness output as set forth herein.

The UI 400 also includes a second setting 410 for providing input indicating locations at which the device is to sense ambient light and/or adjust display brightness output in accordance with present principles. Thus, a first option 412 is selectable by a user to sense ambient light and adjust display brightness everywhere when, e.g., a user initiates an application. A second option 414 is also shown which is selectable by a user to, e.g., upon launch of an application, sense ambient light and/or adjust display brightness output when the user input to launch is received while the device is at a "work" location (e.g., the user's place of business). The setting 410 also includes a third option 416 which is selectable to sense ambient light and/or adjust display brightness output when the user input to launch is received while the device is at a "home" location (e.g., the user's personal residence). Furthermore, note that the setting 410 includes a customize selector 418 which is selectable to cause another option and/or UI to be presented at which a user may specify one or more other locations at which the device is to sense ambient light and/or adjust display brightness output as set forth herein.

Still in reference to FIG. 4, the UI 400 also includes a setting 420 for configuring the device to change display brightness output at a per-application level (e.g., the user may configure different brightness outputs for the display for when and/or while different applications are presented) by selecting option 422, or to change display brightness output based on a universal preference and/or ambient light, but not based on a particular application launched and/or presented, by selecting option 424.

The UI 400 also includes a setting 426 for setting a threshold number of past adjustments (e.g., stored in a history or database on the device) to use when and/or while the device is to sense ambient light and/or adjust display brightness output as set forth herein. Accordingly, a number entry box 428 is presented for the option 426 at which a user may enter a number to establish the threshold number of past adjustments the device is to use. In the present instance, a user has configured the device to use the ten past, most recent adjustments.

The UI 400 may include still other options. For instance, an option 430 is selectable using check box 432 to, when selected, only adjust display brightness output in accordance with present principles when and/or while battery power has fallen to or below a threshold percentage of (e.g., total) battery charge remaining (e.g., while also not engaged with a power source for charging). Thus, a number entry box 434 is included for the option 430 at which a user may enter and/or select a number to establish the threshold percentage.

An option 436 may also be included that is selectable using check box 438 to, when selected, only adjust display brightness output in accordance with present principles when and/or while ambient light at and/or near the device is below a threshold amount. Thus, a number entry box 440 is included for option 436 at which a user may enter and/or select a number to establish the threshold amount of ambient light.

Still further, an option 442 may be included on the UI 400 that is selectable using check box 444 to, when selected, only adjust display brightness output in accordance with present principles when and/or while ambient light at and/or near the device is above a threshold amount and to stop adjusting display brightness output when the ambient light level is below this threshold amount. Thus, a number entry box 446 is included for option 442 at which a user may enter and/or select a number to establish this threshold amount for ambient light.

Additionally, the UI 400 of FIG. 4 may include an option 448 that is selectable using check box 450 to, when selected, adjust display brightness output in accordance with present principles based on one or more colors on a UI, window, page and/or screen (e.g., of an application) being viewed (e.g., in addition to adjusting display brightness based on other factors as disclosed herein, such as ambient light and past user adjustments), such as adjusting display brightness output based on one or more background colors specifically. For instance, the device may determine that a home page, UI, and/or screen of an application being launched has a white background and/or white content (e.g., a majority and/or threshold amount of white background or content based on pixel count and/or percentage of display area on which electronic data is presentable), and hence brightness of the display output need not be as bright as for another page, window, UI, and/or screen of a different application that, when presented upon launch of the different application has a black background or majority black content. Furthermore, present principles are understood to not be limited to black and white backgrounds and content, and that display brightness output may be adjusted incrementally, e.g., from low to high output based on colors from relatively bright to relatively dark such as from white to black with other colors from a color scale included therebetween. For instance, such a color scale may include, e.g., from relatively bright to relatively dark: white, gray, and black (e.g., for a black and white scale); or white, yellow, green, dark purple, and black.

Figure 5:
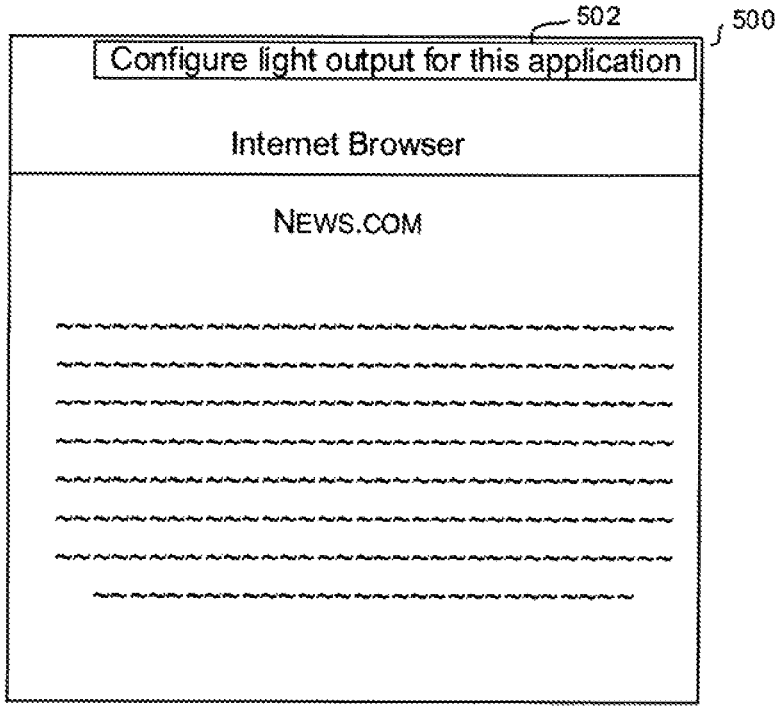

Before moving on to the description of FIG. 5, it is to also be understood that a weighting may be assigned to each factor for adjusting display brightness output, such as to adjusting display brightness output proportionally more based on ambient light and past user adjustments than based on a background color of a screen to be presented and/or already presented. The weighting may be set by a user using the UI 400 such as at option 448 once selected (even though such an option is not shown in FIG. 4 for simplicity), where each factor may be listed on the UI 400 and include a number entry box adjacent thereto at which a user may enter a weight for the associated factor. The weighting may be based on percentage (e.g., to adjust display output 45% based on ambient light, 45% based on past user adjustments, and 10% based on background color), and/or based on a level of importance using a scale from one to ten, or from one to a number corresponding to the number of factors listed on the UI 400.

Continuing now in reference to FIG. 5, it shows an example UI 500 presentable on a display of a device undertaking present principles. The UI 500 is understood to be associated with an application accessible to the device and/or stored thereon. In this example, the UI 500 is associated with an Internet browser application. Note that the UI 500 includes a selector 502 selectable to automatically without further user input cause the device to present a UI for configuring one or more adjustments to display brightness output in accordance with present principles. Thus, in one example embodiment, selection of the selector 502 automatically without further user input causes the device to present the UI 400 described above and/or at least one of the features of the UI 400 discussed above, such as options 430, 436, and 442.

Before concluding, it is to be understood that although a software application for undertaking present principles may be vended with a device undertaking present principles, present principles also apply in instances where such an application is downloaded from a server to a device over a network such as the Internet. Furthermore, present principles apply in instances where such an application is included on a computer readable storage medium that is being vended and/or provided, where the computer readable storage medium is not a transitory signal and/or a signal per se.

While the particular BRIGHTNESS CONTROL METHOD, APPARATUS AND PROGRAM PRODUCT is herein shown and described in detail, it is to be understood that the subject matter which is encompassed by the present application is limited only by the claims.

What is claimed is:

1. A device, comprising:

at least one processor;

a display accessible to the at least one processor; and storage accessible to the at least one processor and comprising instructions executable by the at least one processor to:

present a graphical user interface (GUI) on the display, the GUI comprising a setting that is configurable by an end-user to set one or more locations as locations at which brightness for the display should be adjusted upon, but not before, battery power for the device reaching a threshold percentage of battery power remaining that is less than fully charged but more than no charge.

2. The device of claim 1, wherein the instructions are executable by the at least one processor to:

adjust brightness for the display according to configuration of the setting.

3. The device of claim 1, wherein the GUI comprises at least a first option that is selectable to configure the setting so that brightness for the display is adjusted everywhere.

4. The device of claim 3, wherein the first option is selectable to configure the setting so that brightness for the display is adjusted everywhere responsive to initiation of an application.

5. The device of claim 1, wherein the GUI comprises at least a first option that is selectable to configure the setting so that brightness for the display is adjusted at least at a first predetermined location but not everywhere.

6. The device of claim 5, wherein the first option is selectable to configure the setting so that brightness for the display is adjusted at the first predetermined location responsive to initiation of an application while the device is located at the first predetermined location.

7. The device of claim 1, wherein the GUI comprises:

a first option that is selectable to configure the setting so that brightness for the display is adjusted everywhere;

a second option that is selectable to configure the setting so that brightness for the display is adjusted at least at a first predetermined location but not everywhere.

8. The device of claim 1, wherein the threshold percentage of battery power remaining is twenty percent.

9. The device of claim 1, wherein the GUI comprises a box at which the threshold percentage of battery power remaining is settable by the end-user.

10. A computer readable storage medium (CRSM) that is not a transitory signal, the computer readable storage medium comprising instructions executable by at least one processor of a device to:

present a graphical user interface (GUI) on a display accessible to the at least one processor, the GUI comprising a setting that is configurable by an end-user to set brightness for the display to be adjusted upon battery power for the device reaching a threshold percentage of battery power remaining that is less than fully charged but more than no charge.

11. The CRSM of claim 10, wherein the instructions are executable by the at least one processor to:

adjust brightness for the display according to configuration of the setting.

12. The CRSM of claim 10, wherein the GUI comprises at least a first option that is selectable to configure the setting so that brightness for the display is adjusted everywhere.

13. The CRSM of claim 10, wherein the GUI comprises at least a first option that is selectable to configure the setting so that brightness for the display is adjusted at least at a first predetermined location but not everywhere.

14. The CRSM of claim 10, wherein the setting is configurable via the GUI so that brightness for the display is adjusted responsive to launch of a particular application.

15. A method, comprising:

presenting a graphical user interface (GUI) on a display accessible to a device, the GUI comprising a setting that is configurable by an end-user to set brightness for the display to be adjusted upon battery power for the device reaching a threshold percentage of battery power remaining that is less than fully charged but more than no charge; and adjusting brightness for the display according to configuration of the setting.

16. The method of claim 15, wherein the GUI comprises at least a first option that is selectable to configure the setting so that brightness for the display is adjusted everywhere.

17. The method of claim 15, wherein the GUI comprises at least a first option that is selectable to configure the setting so that brightness for the display is adjusted at least at a first predetermined location but not everywhere.

18. The method of claim 15, wherein the setting is configurable via the GUI so that brightness for the display is adjusted responsive to launch of a particular application.

19. The method of claim 15, wherein the threshold percentage of battery power remaining is twenty percent.

20. The method of claim 15, wherein the GUI comprises a box at which the threshold percentage of battery power remaining is settable by the end-user.

* * * * *